US006497271B1

(12) United States Patent
Heinrich et al.

(10) Patent No.: US 6,497,271 B1
(45) Date of Patent: Dec. 24, 2002

(54) PIG CASTING MACHINE

(75) Inventors: Peter Heinrich, Geldern (DE); Volker Hille, Oberhausen (DE); Ursula Kallenborn-Weber, Essen (DE); Fritz-Peter Pleschiutschnigg, Duisburg (DE); Manfred Albedyhl, Mettmann (DE); Hartmut Hille, Moers (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/762,515

(22) PCT Filed: Aug. 10, 1999

(86) PCT No.: PCT/EP99/05807

§ 371 (c)(1),
(2), (4) Date: Apr. 27, 2001

(87) PCT Pub. No.: WO00/09278

PCT Pub. Date: Feb. 24, 2000

(30) Foreign Application Priority Data

Aug. 10, 1998 (DE) ..... 198 35 824

(51) Int. Cl.[7] ..... B22D 5/04

(52) U.S. Cl. ..... 164/429; 164/479; 164/324; 164/330

(58) Field of Search ..... 164/429, 430, 164/479

(56) References Cited

U.S. PATENT DOCUMENTS

| | | | | |
|---|---|---|---|---|
| 697,769 A | * | 4/1902 | Acklin | 164/329 |
| 3,583,475 A | * | 6/1971 | Yamamoto et al. | 164/329 |

FOREIGN PATENT DOCUMENTS

| | | | |
|---|---|---|---|
| DE | 114428 | * | 7/1899 |
| DE | 809948 | * | 7/1949 |
| FR | 1053147 | * | 2/1954 |
| GB | 937513 | * | 9/1963 |
| JP | 403254335 A | * | 11/1991 |
| JP | 404190944 A | * | 7/1992 |

* cited by examiner

*Primary Examiner*—M. Alexandra Elve
*Assistant Examiner*—Kevin McHenry
(74) *Attorney, Agent, or Firm*—Friedrich Kueffner

(57) ABSTRACT

The invention relates to a pig casting machine comprising at least one endless conveyor belt (2), on which pig casting molds (3) are fixed, for conveying pig casting molds from a casting station (4) to a pig removal station and vice versa, wherein each pig casting mold is filled with molten metal as it passes through the casting station with the mold cavity facing upwards, in addition to a device for cooling the pig casting molds before, during and/or after casting, wherein the pig casting molds are embodied having a thin wall. According to the invention, in order to increase output and to be able to cast heavy metals in such a pig casting machine, the pig casting molds (3, 112, 207) are designed to receive molten metal at a melting temperature above 1,000° C.

13 Claims, 5 Drawing Sheets

PIG CASTING MACHINE

BACKGROUND OF THE INVENTION

1. Field of the Invention

The present invention relates to a pig casting machine comprising an endless conveyor belt, on which pig casting molds are fastened, for transporting the pig casting molds from a casting station to a pig removal station and vice versa, wherein each pig casting mold, with the mold cavity facing upwards, is filled with molten metal as it passes through the casting station, as well as a device for cooling the pig casting molds before, during and/or after casting wherein the pig casting molds are of a thin wall configuration and the rim areas of neighboring pig casting molds overlap.

2. Description of the Related Art

As is known in the art, liquid pig iron is either supplied after tapping in the blast furnace by means of ladles to the steel mill or, if it cannot be processed directly, is cast in the form of ingots, so-called pigs, for storage or for further transport. Pigs of pig iron have different weights depending on the desired application purpose; conventionally, a pig has a weight of 6 kg.

For manufacturing pigs of pig iron, pig casting machines are used. They are conventionally comprised of a casting station, at least one endless conveyor belt as well as a removal station at the first deflection point of the endless belt. Usually, a plurality of thick-walled casting molds are arranged on this endless conveyor belt. The respective casting mold is filled at the casting station with liquid pig iron. The conveying path of the pig casting machine must extend subsequently so far that the liquid iron in the respective pig casting mold is solidified before reaching the first deflection point of the endless conveyor belt and the shrinking enables removal from the casting mold. When passing through the deflection point, the casting molds automatically empty or the pigs are removed by means of a corresponding device from the molds. The pig casting molds or casting molds of known pig casting machines are manufactured of cast iron. In order to accelerate the solidification process of the liquid iron, the casting molds are cooled laterally, and additionally from above, with splashed water.

From German patent document DE 809 948 a pig casting machine for casting light metal and their alloys having correspondingly low melting points is known, wherein the pig casting molds are arranged as an endless belt. It is suggested to form the pig casting molds out of forged metallic material, for example, copper or aluminum or steel, instead of from cast iron. It is described that it is possible in this way to use relatively thin-walled pig casting molds because they can be cooled directly with water before, during, and after casting, for example, by splashing from below.

SUMMARY OF THE INVENTION

Based on this prior art, it is an object of the invention to provide a pig casting machine with increased production output, i.e., an increased quantity of cast molten mass per time interval, and at the same time minimal manufacturing costs for the pig casting molds.

This object is solved by at least one endless conveyor belt, on which pig casting molds are fastened, for transport of the pig casting molds from a casting station to a pig removal station and vice versa, wherein each pig casting molds, with the mold cavities facing upwardly, is filled when passing through the casting station with molten metal, as well as a device for cooling the pig casting molds before, during and/or after casting, wherein the pig casting molds have thin walls, characterized in that the pig casting molds are embodied for receiving molten metal having a melting temperature above 1,000° C.

The invention is based on the recognition, which has been proven by experiments, that the cooling of the pig casting molds makes it possible, quite in contrast to the decade-old unchanged casting exclusively of light metals with a low melting point, to use for casting heavy metals with melting points above 1,000° C. such pig casting molds which are comprised of a heat-resistant material whose melting point is even lower or not significantly higher than the respective melting point of the metal to be cast.

As a result of the minimal wall thickness, the heat conductivity of the pig casting molds is actually no longer of such importance as was the case in the known capacitive cooling. In contrast, the areal cooling across prevents their melting. The molten metal to be cast is, in particular, heavy metal, such as pig iron, which is cast conventionally at temperatures between 1450 and 1520° C. The pig casting molds are comprised preferably of copper whose melting point is approximately 1,083° C. However, materials with significantly reduced heat conductivity are conceivable, for example, heat-resistant steel, whose melting point, depending on its carbon contents, is within a range of 1,520° C.

Accordingly, the criteria for the material of the pig casting mold can be focused on other, essential properties, and, in particular, on the cold or hot forming properties which are decisive for the suitability in a rolling process and a preferred subsequent deep drawing, which allows a cost-efficient manufacture, as well as those mechanical properties at increased temperature which are decisive for the shape stability of the casting mold in use and their insensitivity against cracks. A preferred proposal of the invention suggests thus that the thin-walled precursor material for the pig casting molds is produced by rolling and is subsequently, for example, deep-drawn or die-formed.

According to a first preferred embodiment, it is proposed for achieving an improved cooling situation that carrying baskets on the respective endless conveyor belt are fastened for receiving the individual pig casting molds, wherein the carrying baskets are designed such that they are only partially in supporting contact with the pig casting molds. For this purpose, on the one hand, the inner contour of the carrying baskets is matched approximately to the outer contour of the pig casting molds and, moreover, the inner surface of the carrying baskets is provided with support pins for a point support of the thin-walled pig casting molds, wherein the diameter of the support pins on the carrying basket is not greater than the wall thickness of the pig casting mold. Accordingly, this fulfills the requirements in regard to ensuring a sufficient shape stability of the thin-walled pig casting mold as well as an unimpaired cooling as a result of the point support action.

The carrying basket can also be embodied as a grate basket which supports the respective pig casting mold like a net. In this connection, the configuration and the material for the support medium are to be selected such that they will not counteract a minimal elastic deformation of the pig casting mold as a result of the own weight of the pig. With this elastic deformation and thus minimal widening of the mold, loosening of the pig at the removal station is assisted.

The carrying basket itself can have rolls which run along guide rails. According to another embodiment, the basket is suspended by corresponding securing means in two parallel extending chains.

By means of the carrying basket it is possible to form the walls of the respective pig casting mold so as to be very thin. Casting molds with thin wall thicknesses have the advantage that the risk of fracture formation as a result of thermal stresses is minimized. With reduced wall thickness, however, the shape stability decreases, wherein this disadvantage is compensated by the support action of the carrying basket. As a result of only partial support by means of the support pins or the grate, cooling of the pig casting molds and thus of the cast body by splashing or immersion in a bath is not significantly impaired. In the embodiment of the carrying basket with support pins the diameter of the support pins on the carrying basket should correspond at most to the wall thickness of the pig casting mold so that the cooling at the points of attack of the support pins is not impaired. As a whole, a shape-stable pig casting mold with beneficial cooling properties is provided. The molten mass solidifies quicker, the circulating speed of the endless belt can be increased, and the quantity of molten mass cast per time interval is thus increased.

As an alternative, when the circulating speed remains unchanged, the belt can be configured to be shorter and thus to be less expensive.

As a second embodiment it is proposed to provide the overlap area of the rims of neighboring pig casting molds with a refractory material, wherein preferably the casting mold rim area at the hot side is formed in the overlap area such that a depression for receiving a refractory material results. Starting in this depression, anchoring means for the refractory material are provided.

Because there is no sufficient heat removal possible for the upper one in the area of overlap of two neighboring pig casting molds by splashing with water from below, in this way heat protection of the rim. surface facing the hot side is provided. This solution has the advantage that as a result of the refractory material the use of a cooling water spray in the overlapping area can be reduced and the splash danger as a result of water entering the interior of the pig casting molds can be reduced.

In a preferred embodiment, the pig casting molds are made of laminated material wherein for the layer facing the hot side a material is selected whose melting point is higher than that of copper, in particular, a heat-resistant steel, and for the layer at the cooling side the highly conductive and fracture-resistant copper is selected. The laminated material is preferably manufactured by rolling or explosive cladding with subsequent deformation, for example, by deep drawing, die-forming or the like.

As a whole, the wall thicknesses of the pig casting molds should be in the range between 3 to 20 mm and the ratio of the weight of the pig casting molds to the weight of the pig should be in the range of 0.5 to 2. Conventional pigs of pig iron, in which only the heat dissipation through the metal wall (so-called capacitive cooling) is used, have in contrast to this a weight ratio pig casting mold/pig of much greater than 1, typically of 6.

As a further preferred embodiment it is proposed that a pig casting mold has a plurality of individual casting pans or mold cavities. The pig casting mold can also have a parallelepipedal bottom surface or parallelepipedal casting pans which provides a great advantage in regard to the manufacture of the casting molds.

According to a preferred embodiment, the pig casting molds are cooled from below before, during and after the casting process up to the point of removal of the solidified pig, preferably by areal splashing of cooling water or a water/air mixture. The jet nozzles, depending on the locally required cooling efficiency, can be arranged closely or less closely to one another. When spray cooling, the greater part of the sprayed water evaporates at the underside of the pig casting molds. Drops of water that is not evaporated is collected in a collecting trough and is reused. The collecting trough forms at the same time a housing for removal by vacuum and optionally condensation of the resulting water vapor. An auxiliary cooling device between the removal station and the casting station is possible, but not necessarily required because of the reduced stored heat of the thin-walled casting molds. Moreover, cleaning devices and/or devices for the application of mold coating for the empty pig casting molds can be provided.

According to the invention, the endless belt, in contrast to conventional configurations, is not to be provided with an upper and a lower run but is to be configured horizontally in the way of a carousel. The casting molds are moved in this connection along the carousel arrangement about a circular path of less than 360° by filling them at the casting station with molten mass, transporting them on the circular path, and removing them at the removal station, which is arranged shortly before the casting station. For this purpose, the casting molds are rotated or tilted by 180°. A cooling device in the form of jet nozzles and/or a cooling water collecting trough is arranged such that it begins shortly before the casting station and extends up to the removal station. It is possible, if needed, to use the water collecting trough for the water drops or the condensed water as an immersion tub. As a whole, when employing this configuration, the number of employed pig casting molds is reduced and the use of time is optimized.

As a preferred embodiment it is proposed to design the pig casting molds of a double-wall configuration and to cool them by means of flow-through water cooling. In this connection, in the carousel arrangement a ring distribution line is provided which rotates correspondingly together with the pig casting molds in the horizontal carousel arrangement and is supplied by a rotating line in the center of the carousel, wherein the ring distribution line has hoses which, in turn, supply cooling cross-sections which are positioned in intermediate spaces of the double-wall pig casting molds.

BRIEF DESCRIPTION OF THE DRAWINGS

Further details, features, and advantages of the invention result from the claims and the following description. It is shown in:

DESCRIPTION OF PREFERRED EMBODIMENTS

Figure 1:
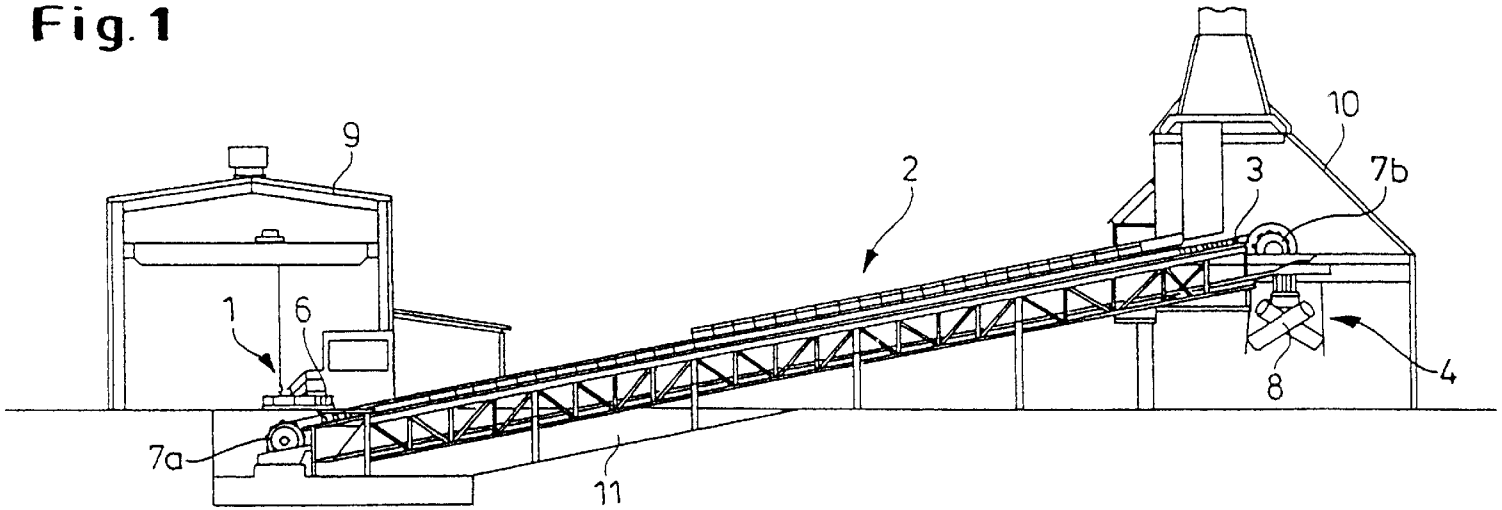
FIG. 1 a side view of a pig casting machine.
Figure 2:
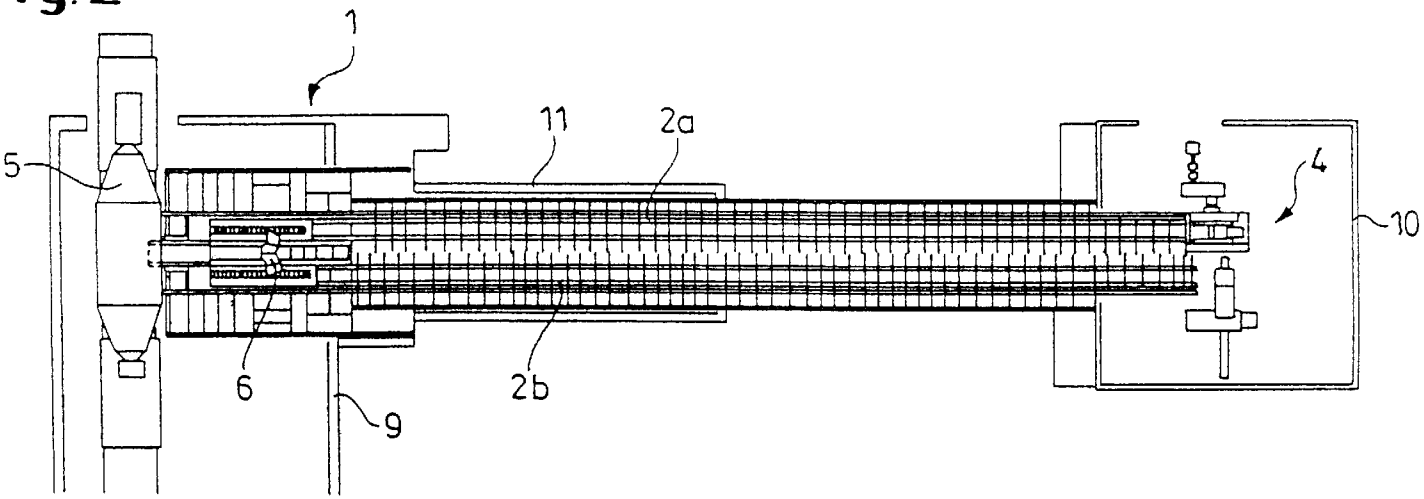
FIG. 2 a plan view onto the pig casting machine according to FIG. 2.

The pig casting machine according to FIGS. 1 or 2 is comprised essentially of the elements casting station 1, two parallel endless conveyor belts 2*a, b* with a plurality of pig casting molds 3 arranged thereon (only shown in an exemplary fashion) as well as a removal or collecting station 4. The endless belts serve for transporting the pig casting molds from the casting station to the removal station and vice versa, wherein each pig casting mold, with the mold cavity facing upwardly, is filled at the casting station with molten metal. For this purpose, liquid pig iron is supplied by means of torpedo ladles 5 (compare FIG. 2) and is continuously cast with a suitable casting device 6 into the individual pig casting molds.

An endless belt 2 is comprised in the illustrated embodiment of a recess chain and is guided with formation of an upper run and a lower run about two rolls 7*a, b* which are located at the casting station 1 and the removal station 4 and are operated by means of a chain wheel drive station. In the embodiment according to FIG. 1, the respective endless belt 2 illustrated in FIG. 1 transports the casting molds 3 with their mold cavities facing upwardly in the upward direction. Upon reaching the removal station 4, the pigs of pig iron are solidified to such an extent that they fall automatically out of the casting molds when passing the deflection point of the belt about the roll 7*b*. The pigs fall onto a pig catching slide 8, which is illustrated here comprised of two slide elements, and are collected by them in a wagon or container (not illustrated). In particular, shortly before&the casting station, in the casting station, and between it and the removal station, cooling devices (not shown) in the form of spray nozzles are provided so that the pig casting molds can be areally sprayed from below. The stations 1 and 4 are enclosed by suitable housings 9 and 10, respectively, so as to be vapor-tight. The endless conveyor belts 2 are protected partially by a housing 11.

Figure 3:
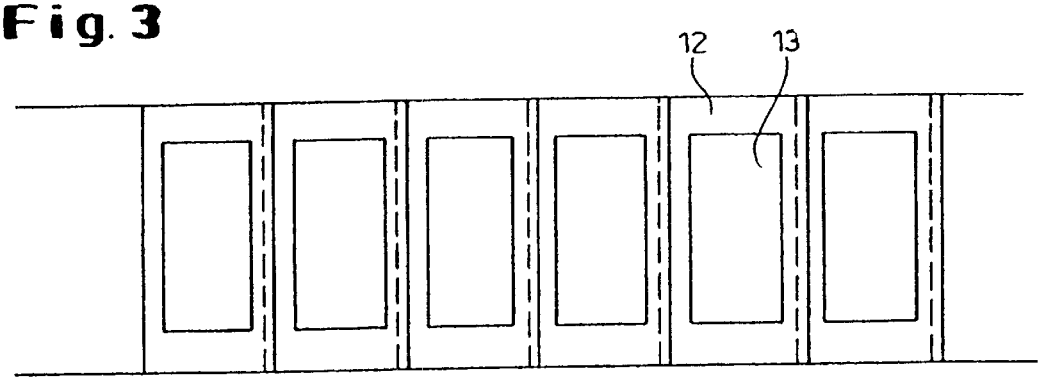
FIG. 3 a schematic illustration of successively arranged pig casting molds in a plan view.
Figure 4:
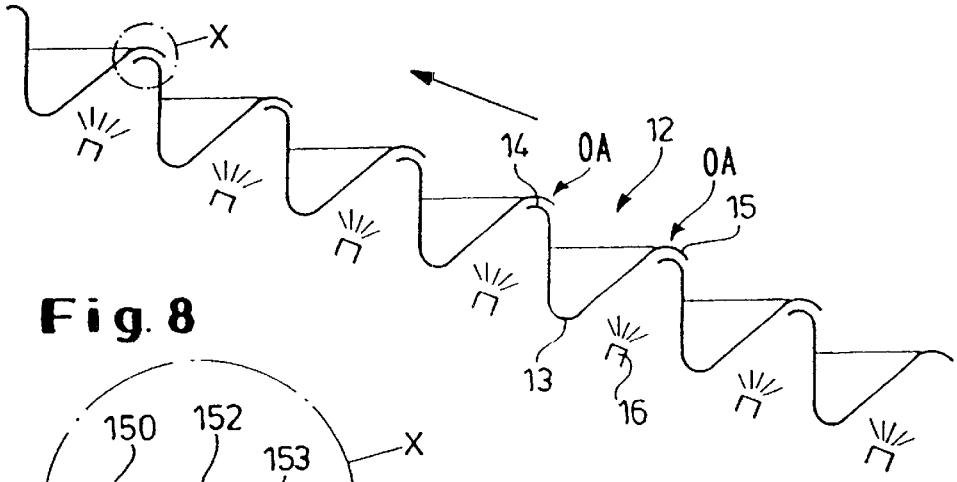
FIG. 4 the schematic illustration of the cross-section A—A of FIG. 1.

The FIGS. 3 and 4 show schematically the plan view and sectional view A—A of a detail of such an endless belt 2 with several neighboring thin-walled pig casting molds wherein in the following only one casting mold will be described as an example. The casting mold 12 is provided with a corresponding mold cavity 13 for receiving the molten mass. The two rim areas 14, 15 of the casting mold along their longitudinal axis overlap respectively with the rim areas of the neighboring casting molds. The overlap areas are identified at OA. As a result of the overlapping casting molds, a continuous casting process with a continuously moving endless belt is possible. In this connection, one rim area of a casting mold forms the rim area 14 at the cooling side, respectively, and the other side forms the rim area 15 of the hot side which overlaps the other and is thus in direct contact with the hot molten mass. A casting mold belt of such a configuration is sprayed from below with cooling water via nozzles; shown here in an exemplary fashion nozzle 16.

Figure 5:
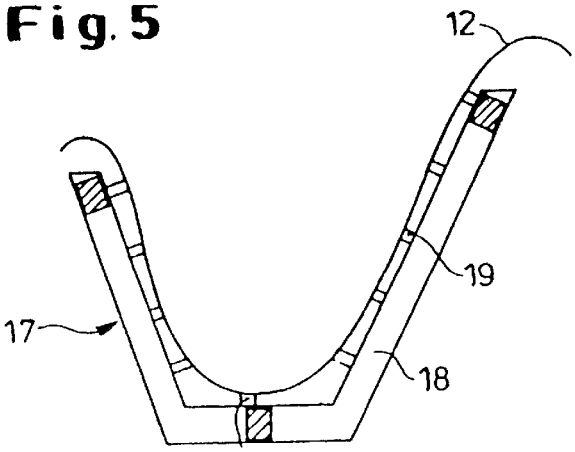
FIG. 5 the schematic enlarged illustration of the cross-section along the wide side of the pig casting mold with carrying basket.
Figure 6:
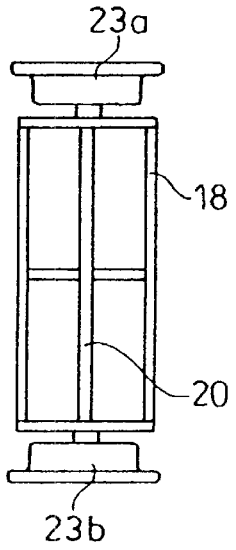
FIG. 6 the schematic plan view of a pig casting mold with carrying basket.
Figure 7:
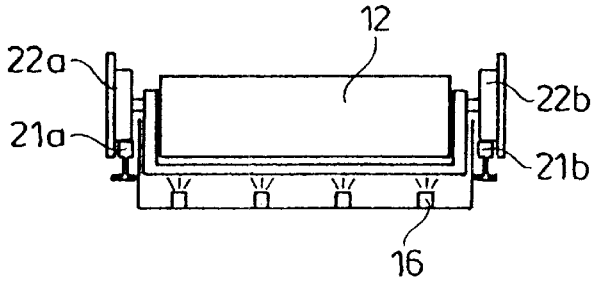
FIG. 7 the schematic illustration of the cross-section along the longitudinal axis of the pig casting mold of FIG. 6.

In FIG. 5, the sectional view of the placement of such a thin-walled pig casting mold 12 in a carrying basket 17 is illustrated. The carrying basket is comprised of a carrying frame 18 which is provided with support pins 19 which support the pig casting mold 12 with point contact. FIG. 6 shows in a plan view that the support frame 18 is provided with two running wheels 23*a, b* which are supported on a longitudinal bolt 20. The wheels run on corresponding guide rails 21*a, b* (compare FIG. 7). For ensuring straight running of the endless belt, the running wheels 23*a, b* are provided with wheel flanges 22*a, b* at the outer side. FIG. 7 illustrates that the carrying baskets 12 are sprayed with cooling water from below.

Figure 8:
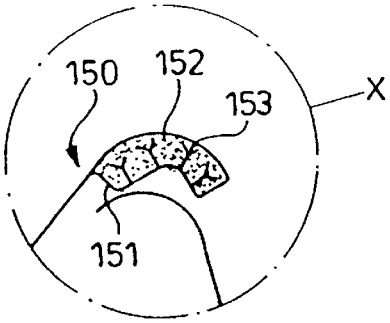
FIG. 8 the schematically enlarged illustration of the detail X of FIG. 4 showing the cross-section of the overlap area of two neighboring pig casting molds with refractory lining.
Figure 9:
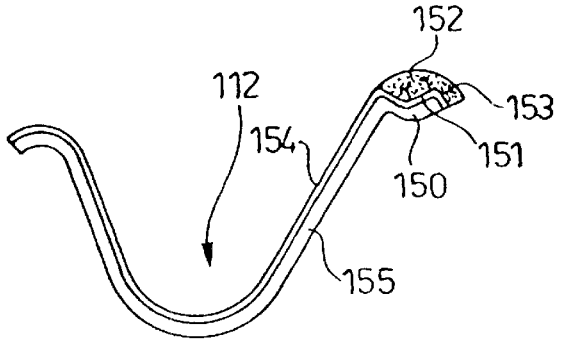
FIG. 9 the schematic illustration of the cross-section along the wide side of a pig casting mold of laminated material.

In addition to the shape stabilization of the thin-walled pig casting molds as a result of the carrying baskets, it is suggested to protect the overlapping rim areas of neighboring pig casting molds with a refractory material layer, see FIG. 8, which is a detail view of FIG. 4. For this purpose, the rim 150 at the hot side is formed such that a depression 151 results which receives the refractory material 152. Along the depression 151 anchoring means 153 are provided which secure the refractory material. In comparison to FIG. 4, it becomes clear that the areas which cannot be reached so easily by spray cooling are protected by the refractory material. The arrangement of the refractory material is also clearly illustrated in the embodiment according to FIG. 9, wherein here the pig casting mold is produced of a laminated material. At the hot side the casting mold is comprised of a layer 154 of heat-resistant steel, at the cooling side of a copper layer 155.

Figure 10:
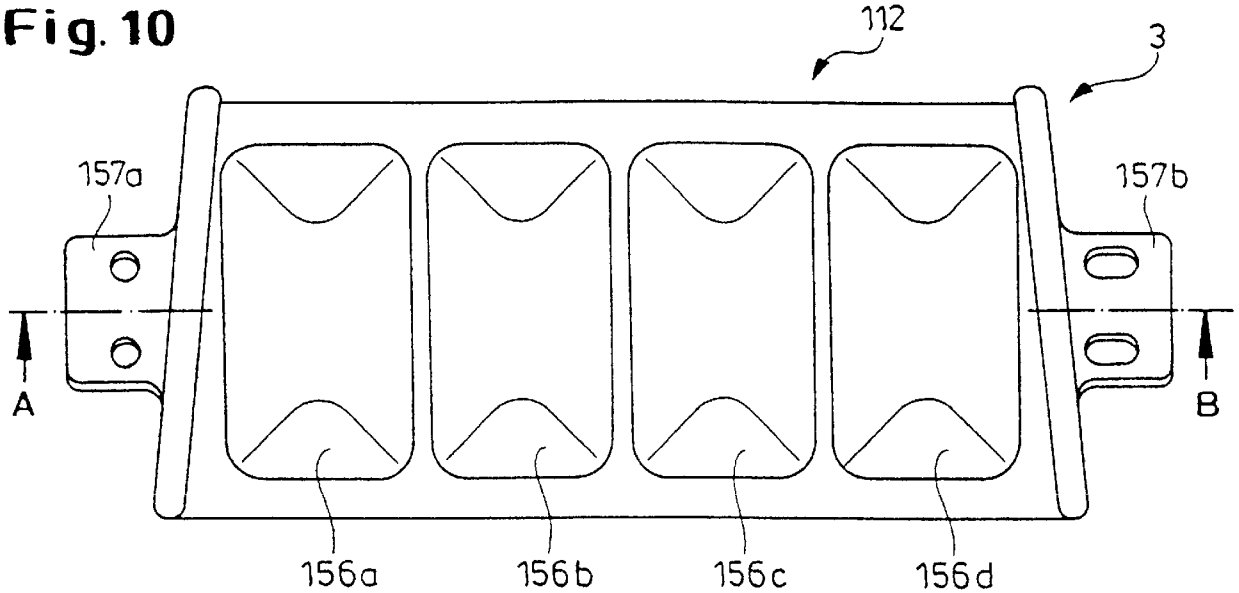
FIG. 10 a plan view onto a pig casting mold with several mold cavities.
Figure 11:
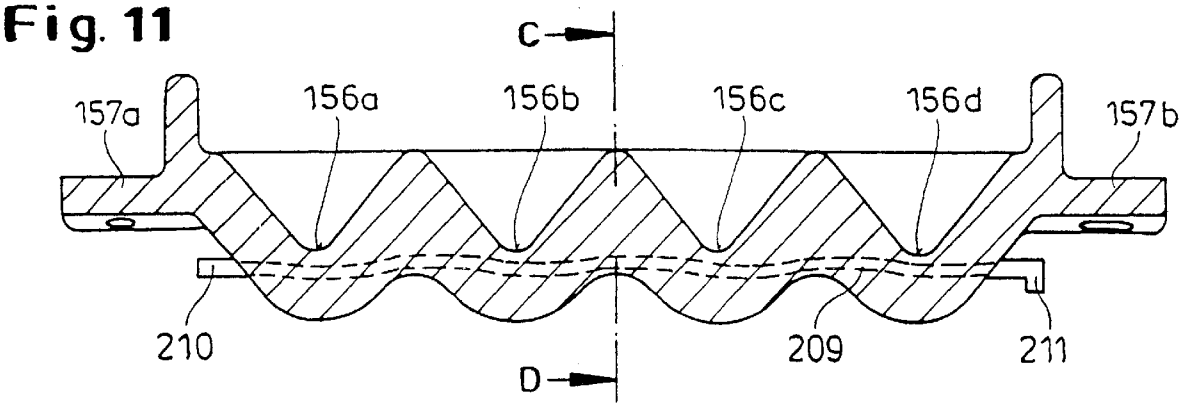
FIG. 11 the sectional view A–B of the pig casting mold according to FIG. 10.

FIG. 10 illustrates an embodiment of the plated casting mold 112 with four casting molds 156*a* to 156*d*. Such plated casting molds can be connected with corresponding securing elements 157*a, b* to a drive chain (not illustrated). FIG. 11 shows the sectional view A–B of FIG. 10, wherein here the wall area is shown to be relatively thick for illustration purposes of the cooling hoses 209 of the cooling system in FIG. 13.

Figure 12:
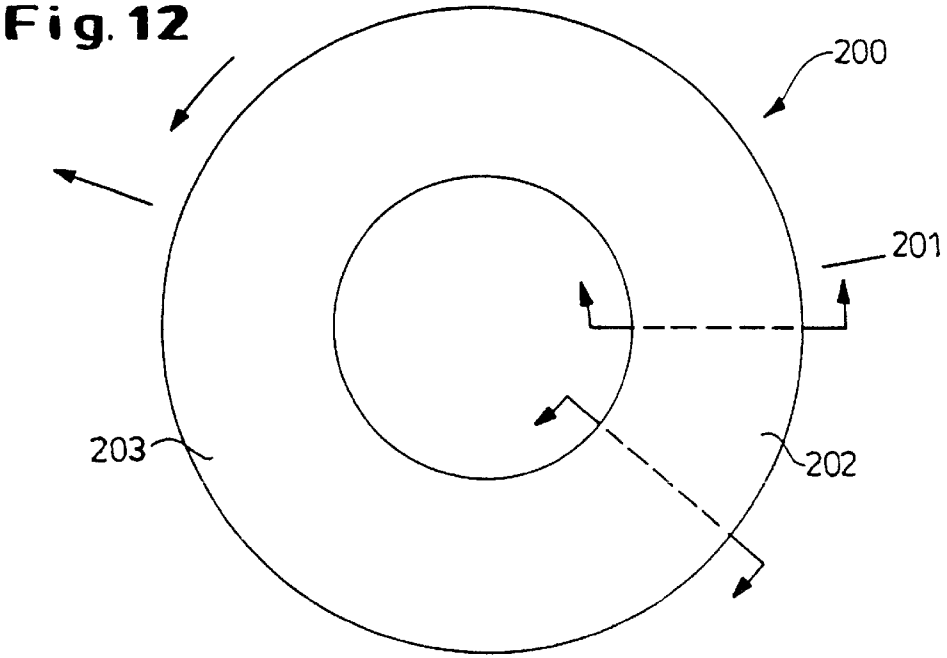
FIG. 12 a plan view onto a pig casting machine in a carousel arrangement with the individual stations.

FIG. 12 is a plan view showing an overview of a pig casting machine 200 in the embodiment of a horizontal carousel arrangement, wherein the rotational direction of the endless belt 203 is indicated with the arrow. The individual stations of the pig casting machine 200 are schematically illustrated. Reference numeral 201 shows the casting station and thus the point of supply of the pig iron into the casting molds. In front of the casting station 201, a cooling device in the form of nozzles or collecting tubs with cooling water are arranged which extend to a point shortly before the removal station 202. The beginning and the end of the cooling device are schematically illustrated by dash-dotted lines. The removal station 202 can be positioned shortly before the casting station 201 because the pig casting molds after removal must be cooled further only to a minimal degree. Upon passing through the collecting tubs, cooling is carried out areally by immersion of the pig casting molds with their underside into the cooling water.

Figure 13:
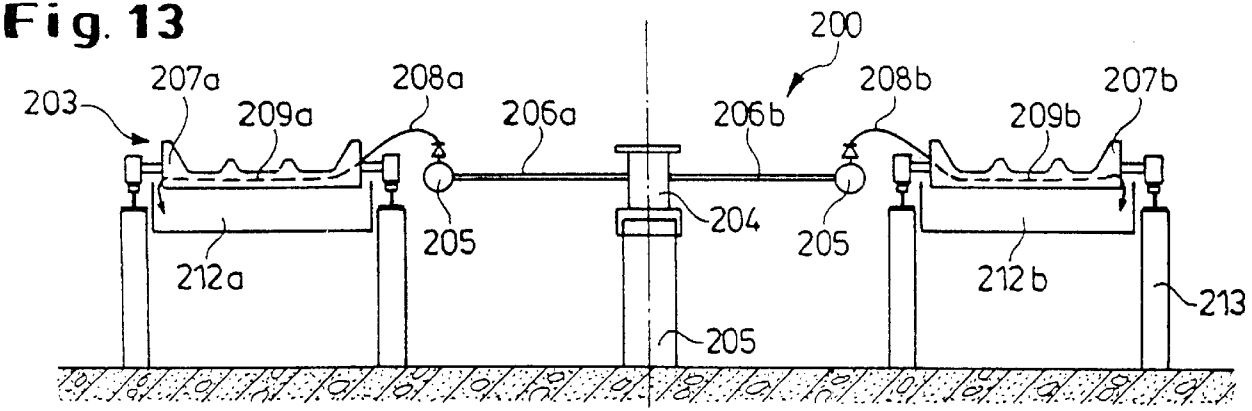
FIG. 13 a lateral sectional view of the carousel arrangement with a cooling device as a ring distribution line.

As an alternative to the cooling by means of spray nozzles or a collecting tub, a preferred proposal resides in providing a through-flow water cooling with a ring distribution line, as illustrated in FIG. 13. For this purpose, in the center of the endless belt carousel 203 a rotary leadthrough 204 is provided with a cooling water inlet 205. The rotational drives for the cooling device as well as the endless belt for the casting molds are not illustrated. By means of these rotary leadthrough 204 a ring distribution line 205, which also rotates with the endless belt, is supplied via radially extending supply lines 206*a, b,* wherein each pig casting mold 207*a, b* etc. has a supply line 206*a, b* correlated therewith. For connecting the supply lines 206*a, b* etc. to the pig casting molds, hoses 208*a,* 208*b* are provided. The hoses 208*a, b* make possible the tilting and rotation of the individual pig casting molds 207*a, b* when they are being emptied. These hoses 208*a, b* supply, in turn, cooling hoses 209*a, b* which are arranged in the double-walled pig casting molds (compare also FIG. 11). These cooling hoses 209*a, b* are provided with hose connectors 210 and hose outlets 211, respectively. In the illustrated embodiment the cooling water after passing through the respective pig casting mold is collected in a collecting trough 212*a,* 212*b,* wherein the bottom of the collecting trough 212*a,* 212*b* is slanted toward the outlet. A connection to a cooling water circuit which is pressurized is also conceivable. As a whole, the guiding means for the endless belt 203 is provided on a corresponding support construction 213.

A pig casting machine with the proposed casting molds can be used as a result of its higher capacity not only in iron foundries but also in integrated steel works as an alternative for the ladle transport or for a tapping of the pig iron into pig beds, which is an environmental hazard because of the emissions. Also, the use of such pig casting machines in electric steel plants with a blast furnace located directly upstream is possible. It is thus possible to cast excess material, that is presents as a result of different production cycles and availabilities, to pigs which then can be melted, as needed, at a later point in time in an electric furnace.

What is claimed is:

1. A pig casting machine, comprising at least one endless conveyor belt, on which pig casting molds having a mold cavity, respectively, are fastened, for transport of the pig casting molds from a casting station to a pig removal station and vice versa, wherein each pig casting mold, with the mold cavity facing upwardly, is filled when passing through the casting station with molten metal, as well as a device for cooling the pig casting molds before, during and/or after casting, wherein the pig casting molds have thin walls, wherein the pig casting molds (3, 112, 207) are embodied for receiving molten heavy metal having a melting temperature above 1,000° C., wherein carrying baskets (17) are provided and fastened on the respective endless conveyor belt for receiving the individual pig casting molds (12), wherein the carrying baskets are designed such that the carrying baskets are only partially in supporting contact with the pig casting molds, wherein an inner contour of the carrying baskets is matched approximately to an outer contour of the pig casting molds and, for providing the supporting contact, is provided with support pins (19) providing a point support of the thin walls of the pig casting molds.

2. The pig casting machine according to claim 1, wherein pig casting molds are comprised of rolled precursor material.

3. The pig casting machine according to claim 1, wherein the diameter of the support pins on the carrying baskets is not greater than a wall thickness of the pig casting molds.

4. The pig casting machine according to claim 3, wherein the wall thickness of the respective pig casting mold is in the range between 3 to 20 mm and a ratio of weight of the pig casting mold to weight of the pig is in the range of 0.5 to 2.

5. The pig casting machine according to claim 1, wherein the carrying baskets are formed as grate baskets which support the respective pig casting mold like a net.

6. The pig casting machine according to claim 1, wherein neighboring pig casting molds have rim areas that overlap and form an overlap area, wherein the overlap area (150) is provided with refractory material (152).

7. The pig casting machine according to claim 6, wherein the rim area (150) of the casting mold at a hot side in the overlap area is formed such that a depression (151) for receiving the refractory material (152) results and that, starting at this depression, anchoring means (153) are provided for the refractory material.

8. The pig casting machine according to claim 6, wherein the pig casting molds are comprised of a laminated material, wherein for the layer (154) at a hot side a material is selected whose melting point is higher than that of copper and copper is selected for the layer (155) at the cooling side.

9. The pig casting machine according to claim 8, wherein the layer (154) at the hot side is heat resistant steel.

10. The pig casting machine according to claim 1, wherein a pig casting mold has a plurality of individual casting pans (156*a* to 156*d*).

11. The pig casting machine according to claim 1, the cooling device has nozzles (16) for a directed spraying of the cooling medium onto the casting molds, in particular, for a directed spraying from below, or is formed as a throughflow trough filled with cooling medium, in which the undersides of the casting molds are partially immersed during their transport.

12. The pig casting machine according to claim 1, wherein the endless belt (203) extends horizontally corresponding to a carousel arrangement and devices are provided at the removal station (202) for separating the pig casting molds from one another as well as for emptying by a rotary or tilting movement.

13. The pig casting machine according to claim 12, wherein the cooling device comprises a ring distribution line (205) which rotates together with the pig casting molds in horizontal carousel arrangement and is supplied by a rotating supply line (204) in the center of the carousel, wherein the ring distribution line (205) comprises hoses (208*a, b*) which, in turn, supply cooling cross-sections (209*a, b*) which are formed in intermediate spaces of double-walled pig casting molds (207*a, b*).

* * * * *